US009216868B1

(12) United States Patent
Li et al.

(10) Patent No.: US 9,216,868 B1
(45) Date of Patent: Dec. 22, 2015

(54) PAPER STAGING MECHANISM

(71) Applicant: Foxlink Image Technology Co., Ltd, New Taipei (TW)

(72) Inventors: Fong Jhou Li, New Taipei (TW); Wei Yuan Peng, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 0 days.

(21) Appl. No.: 14/474,828

(22) Filed: Sep. 2, 2014

(51) Int. Cl.

| | |
|---|---|
| ***B65H 3/06*** | (2006.01) |
| ***B65H 3/52*** | (2006.01) |
| ***B65H 1/06*** | (2006.01) |
| ***B65H 7/02*** | (2006.01) |
| ***B65H 5/06*** | (2006.01) |

(52) U.S. Cl.
CPC ..... *B65H 3/063* (2013.01); *B65H 1/06* (2013.01); *B65H 3/0607* (2013.01); *B65H 3/0676* (2013.01); *B65H 3/5284* (2013.01); *B65H 5/068* (2013.01); *B65H 7/02* (2013.01)

(58) Field of Classification Search
CPC ..... B65H 7/125; B65H 7/14; B65H 7/06; B65H 2701/1311; B65H 2513/11; B65H 3/063; B65H 3/5284; B65H 1/06
See application file for complete search history.

(56) References Cited

U.S. PATENT DOCUMENTS

| | | | | |
|---|---|---|---|---|
| 4,696,462 | A * | 9/1987 | Tanaka et al. | 271/10.11 |
| 5,397,107 | A * | 3/1995 | Wolog et al. | 271/10.04 |
| 2007/0045934 | A1* | 3/2007 | Hsieh | 271/110 |
| 2012/0061905 | A1* | 3/2012 | Wu et al. | 271/34 |
| 2013/0221606 | A1* | 8/2013 | Lai et al. | 271/34 |
| 2013/0328260 | A1* | 12/2013 | Matsushita et al. | 271/109 |

FOREIGN PATENT DOCUMENTS

| | | | |
|---|---|---|---|
| JP | 08169631 | A * | 7/1996 |
| JP | 2004075210 | A * | 3/2004 |

* cited by examiner

*Primary Examiner* — Luis A Gonzalez
(74) *Attorney, Agent, or Firm* — Muncy, Geissler, Olds & Lowe, P.C.

(57) ABSTRACT

A paper staging mechanism includes a picking mechanism, a separating mechanism and a detecting mechanism. The picking mechanism picks up papers and further transmits the papers rearward. The separating mechanism separates the papers from the picking mechanism and further transmits the separated paper rearward. The detecting mechanism is mounted to rear of the picking mechanism and the separating mechanism. The separated paper by the separating mechanism co-working with the picking mechanism passes rearward through the detecting mechanism. The detecting mechanism detects a relative distance between two adjacent papers which successively pass through the detecting mechanism so as to control the picking mechanism to adjust transmission speed of the papers for achieving a fixed distance between two adjacent papers.

9 Claims, 4 Drawing Sheets

PAPER STAGING MECHANISM

BACKGROUND OF THE INVENTION

1. Field of the Invention

The present invention relates to a paper staging mechanism capable of keeping a fixed distance between two adjacent papers in the process of being scanned.

2. The Related Art

A traditional paper staging mechanism includes a picking mechanism, a separating mechanism and an image scanning mechanism. In use, the separating mechanism separates papers from the picking mechanism and further transmits the separated paper to the image scanning mechanism where the paper is scanned to get a digital scan image. However, since the transmission of the papers is easily influenced by abrasion or skid of rollers of the paper staging mechanism, there is an unfixed relative distance between two adjacent papers which successively pass through the image scanning mechanism. As a result, the digital scan image has an uncertain size.

SUMMARY OF THE INVENTION

Accordingly, an object of the present invention is to provide a paper staging mechanism capable of adjusting a relative distance between two adjacent papers in the process of being scanned. The paper staging mechanism includes a picking mechanism, a separating mechanism and a detecting mechanism. The picking mechanism includes a picking roller assembly, a pressing mechanism and a driving mechanism. The driving mechanism is mounted to a side of the picking roller assembly and drives the picking roller assembly to rotate. The pressing mechanism is located over the picking roller assembly. The picking roller assembly rotates to pick up the paper and further feed the paper rearward under the cooperation of the pressing mechanism pressing against the paper. The separating mechanism is mounted to rear of the pressing mechanism and located over the picking roller assembly. The separating mechanism separates the papers from the picking mechanism and further transmits the separated paper rearward. The detecting mechanism is mounted to rear of the picking mechanism and the separating mechanism. The detecting mechanism includes a sending component and a receiving component which is apart disposed corresponding to the sending component. The separated paper by the separating mechanism co-working with the picking roller assembly of the picking mechanism passes rearward through between the sending component and the receiving component of the detecting mechanism. The sending component and the receiving component of the detecting mechanism detect the relative distance between two adjacent papers which successively pass through the detecting mechanism. When the relative distance is abnormal, the detecting mechanism feeds back abnormal signals to the driving mechanism. The driving mechanism controls the rotation of the picking roller assembly to speed up or slow down so as to achieve a fixed distance between two adjacent papers.

As described above, the embodiment of the invention of the paper staging mechanism utilizes the sending component and the receiving component of the detecting mechanism to detect the relative distance between two adjacent papers, so as to adjust the relative distance and keep a fixed distance between two adjacent papers in the process of being scanned. So it can effectively reduce scanned image problems.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
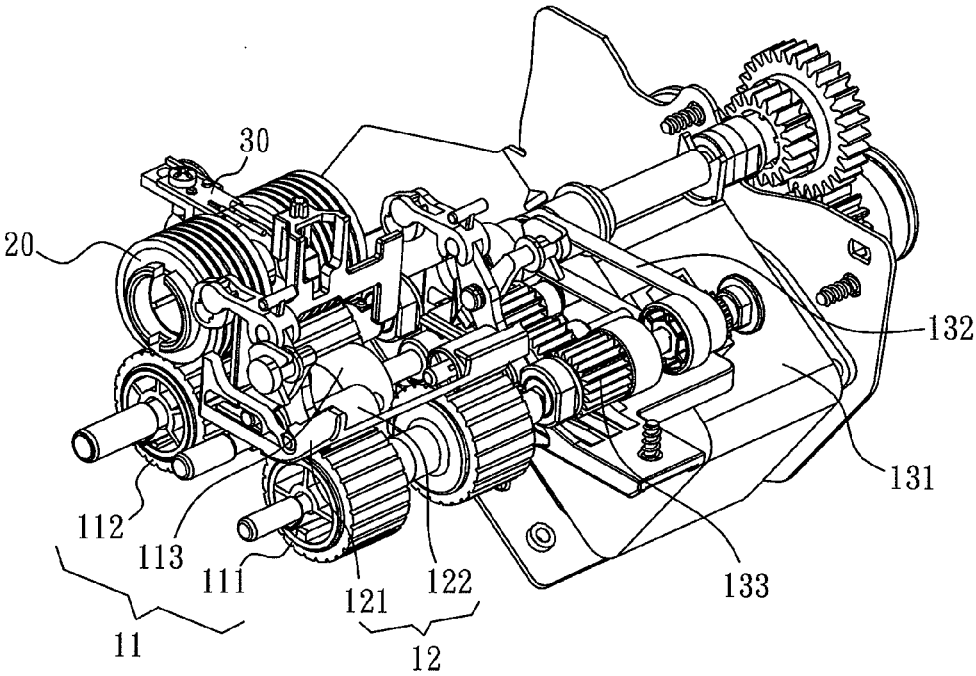
FIG. 1 is an assembled, perspective view of a paper staging mechanism in accordance with an embodiment of the present invention.
Figure 2:
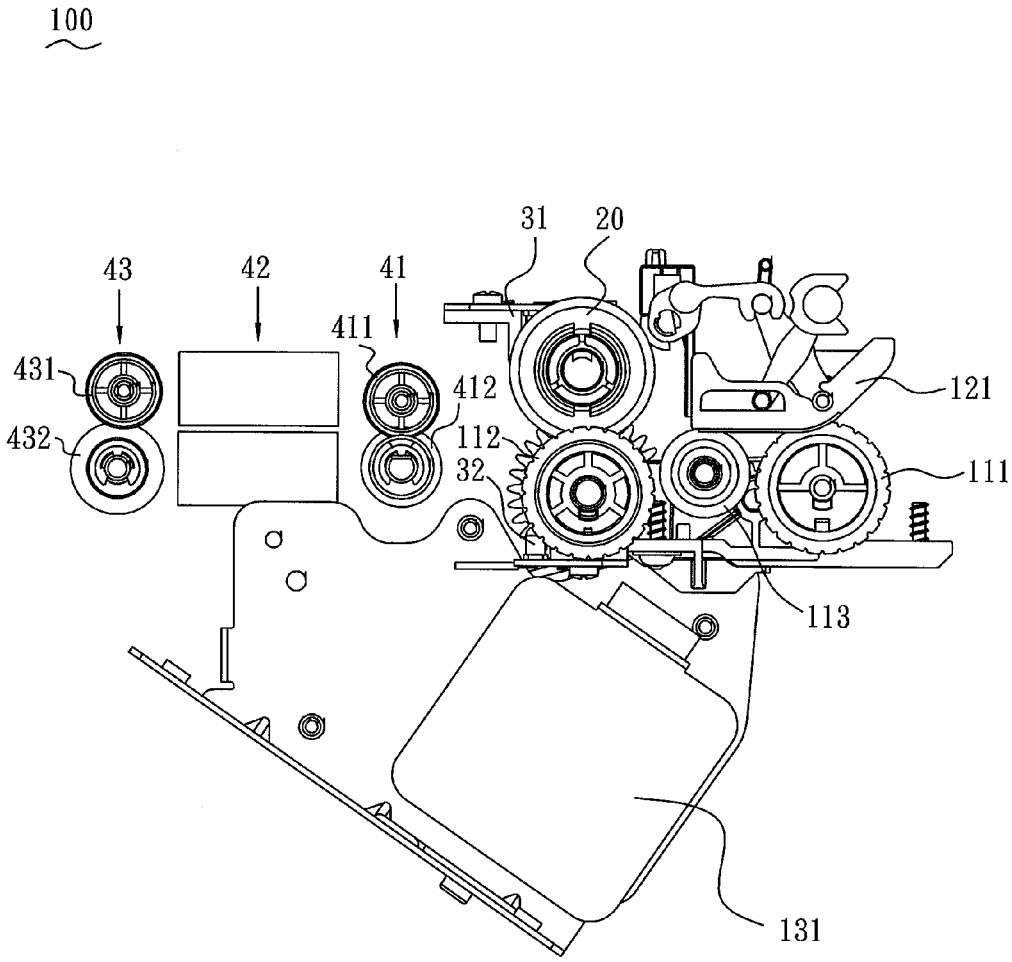
FIG. 2 is a side view of the paper staging mechanism of FIG. 1.
Figure 3:
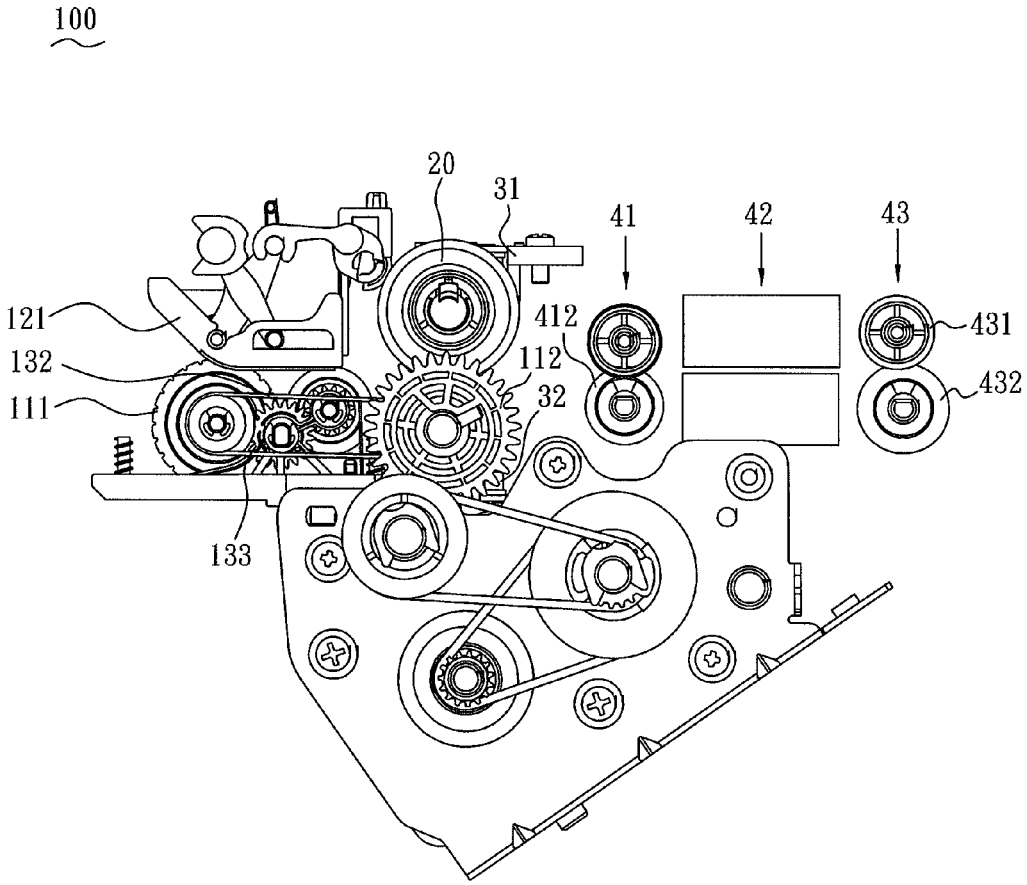
FIG. 3 is another side view of the paper staging mechanism of FIG. 1.
Figure 4:
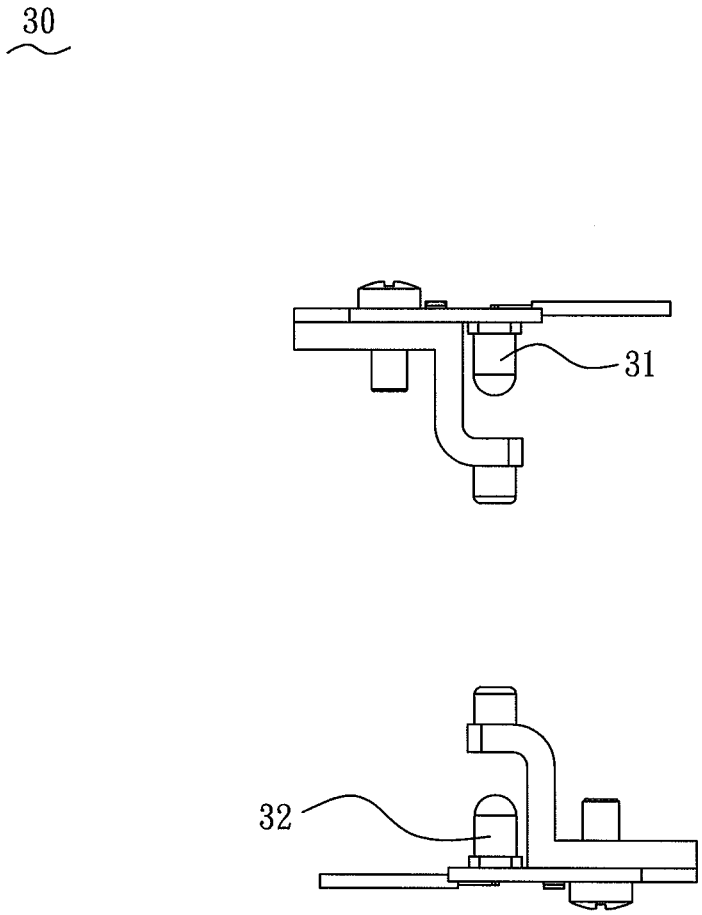
FIG. 4 is a diagrammatic drawing of a detecting mechanism of the paper staging mechanism of FIG. 1.

Referring to the drawings in greater detail, and first to FIGS. 1-3, an embodiment of the present invention is embodied in a paper staging mechanism 100 capable of keeping a fixed distance between two adjacent papers in the process of being scanned. The paper staging mechanism 100 includes a picking mechanism (not labeled), a separating mechanism 20, a detecting mechanism 30, a feeding roller assembly 41, an image scanning mechanism 42 and an exiting roller assembly 43.

Referring to FIGS. 1-3, the picking mechanism includes a picking roller assembly 11, a pressing mechanism 12 and a driving mechanism (not labeled). The picking roller assembly 11 includes a first picking roller 111, a second picking roller 112 and a third picking roller 113 which are arranged in the same horizontal plane. The first picking roller 111 is in front of the second picking roller 112 and the third picking roller 113 is between the first picking roller 111 and the second picking roller 112. The pressing mechanism 12 includes a pressing plate 121 and a pressing roller 122 rotatably mounted to the pressing plate 121. The pressing mechanism 12 is located over the first picking roller 111 and the third picking roller 113 of the picking roller assembly 11. The pressing plate 121 presses against the paper and the pressing roller 122 is driven by the first picking roller 111 of the picking roller assembly 11 to rotate so as to pick up the paper and further feed the paper rearward. The driving mechanism includes a motor 131, a belt 132 and a gear assembly 133. The motor 131 of the driving mechanism is mounted to a side of the picking roller assembly 11 for driving the second picking roller 112 of the picking roller assembly 11 to rotate. The belt 132 of the driving mechanism is worn around the first picking roller 111 and the second picking roller 112 of the picking roller assembly 11. The second picking roller 112 drives the first picking roller 111 to synchronously rotate by the belt 132. The gear assembly 133 is mounted to a side of the first picking roller 111 and the third picking roller 113 of the picking roller assembly 11 and is meshed with one another. The first picking roller 111 of the picking roller assembly 11 drives the third picking roller 113 to rotate by the gear assembly 133.

The separating mechanism 20 is mounted to rear of the pressing plate 121 of the pressing mechanism 12 and located over the second picking roller 112 of the picking roller assembly 11. In the embodiment of the present invention, the separating mechanism 20 includes a group of separating rollers. The separating mechanism 20 separates the papers from the picking mechanism and further transmits the separated paper rearward to the image scanning mechanism 42.

Referring to FIGS. 1-4, the detecting mechanism 30 is mounted to rear of the picking mechanism and the separating mechanism 20, and the image scanning mechanism 42 is mounted to rear of the detecting mechanism 30. The detecting mechanism 30 includes a sending component 31 and a receiving component 32 which is apart disposed corresponding to the sending component 31. In the work status, the separating mechanism 30 co-works with the picking roller assembly 11 of the picking mechanism to separate the papers and further transmits the separated paper rearward through between the sending component 31 and the receiving component 32 of the detecting mechanism 30 to the image scanning mechanism 42. The sending component 31 and the receiving component 32 of the detecting mechanism 30 detect the relative distance between two adjacent papers which successively pass through the detecting mechanism 30. When the relative distance is abnormal, the detecting mechanism 30 feeds back abnormal signals to the driving mechanism, and the driving mechanism controls the rotation of the picking roller assembly 11 to speed up or slow down so as to achieve a fixed distance between two adjacent papers so that can effectively reduce scanned image problems.

In the embodiment of the present invention, the detecting mechanism 30 is a gap sensor. The sending component 31 is set over the receiving component 32 in vertical direction. The sending component 31 and the receiving component 32 are set by being not limited to above said position, the sending component 31 and the receiving component 32 can be set in a certain angle. Even the sending component 31 and the receiving component 32 can swap places.

Referring to FIG. 2 and FIG. 3, the feeding roller assembly 41 is mounted to rear of the detecting mechanism 30 and adjacent to the picking mechanism and the separating mechanism 20. The feeding roller assembly 41 further includes a feeding idler roller 411 and a feeding driving roller 412 located under the feeding idler roller 411. In detail, the sending component 31 of the detecting mechanism 30 is set between the separating mechanism 20 and the feeding driving roller 412 and the receiving component 32 of the detecting mechanism 30 is set between the picking roller assembly 11 and the feeding driving roller 412. The exiting roller assembly 43 is mounted to rear of the feeding roller assembly 41. The image scanning mechanism 42 is set between the feeding roller assembly 41 and the exiting roller assembly 43. The exiting roller assembly 43 further includes an exiting idler roller 431 and an exiting driving roller 432 located under the exiting idler roller 431. The feeding roller assembly 41 receives the paper from the separating mechanism 20 through the detecting mechanism 30. Then the paper is transmitted by the feeding driving roller 412 and the feeding idler roller 411 of the feeding roller assembly 41 to the image scanning mechanism 42. After scanning, the paper is transmitted rearward by the exiting driving roller 432 and the exiting idler roller 431 of the exiting roller assembly 43.

As described above, the embodiment of the invention of the paper staging mechanism 100 utilizes the sending component 31 and the receiving component 32 of the detecting mechanism 30 to detect the relative distance between two adjacent papers, so as to adjust the relative distance and keep a fixed distance between two adjacent papers in the process of being scanned. So it can effectively reduce scanned image problems.

What is claimed is:

1. A paper staging mechanism capable of adjusting a relative distance between two adjacent papers in the process of being scanned, comprising:

a picking mechanism including a picking roller assembly, a pressing mechanism and a driving mechanism, the driving mechanism being mounted to a side of the picking roller assembly and driving the picking roller assembly to rotate, the pressing mechanism being located over the picking roller assembly, wherein the picking roller assembly rotates to pick up the paper and further feed the paper rearward under the cooperation of the pressing mechanism pressing against the paper;

a separating mechanism mounted to rear of the pressing mechanism and located over the picking roller assembly, wherein the separating mechanism separates the papers from the picking mechanism and further transmits the separated paper rearward; and a detecting mechanism mounted to rear of the picking mechanism and the separating mechanism, the detecting mechanism including a sending component and a receiving component which is apart disposed corresponding to the sending component, wherein the separated paper by the separating mechanism co-working with the picking roller assembly of the picking mechanism passes rearward through between the sending component and the receiving component of the detecting mechanism;

wherein the sending component and the receiving component of the detecting mechanism detect the relative distance between two adjacent papers which successively pass through the detecting mechanism, when the relative distance is abnormal, the detecting mechanism feeds back abnormal signals to the driving mechanism, and the driving mechanism controls the rotation of the picking roller assembly to speed up or slow down so as to achieve a fixed distance between two adjacent papers, and wherein the pressing mechanism includes a pressing plate and a pressing roller rotatably mounted to the pressing plate, the pressing plate presses against the paper and the pressing roller is driven by the picking roller assembly to rotate so as to pick up the paper and further feed the paper rearward.

2. The paper staging mechanism as claimed in claim 1, wherein the picking roller assembly includes a first picking roller, a second picking roller and a third picking roller which are arranged in the same horizontal plane, the first picking roller is in front of the second picking roller and the third picking roller is between the first picking roller and the second picking roller, the pressing mechanism is located over the first picking roller and the third picking roller of the picking roller assembly, the separating mechanism is located over the second picking roller of the picking roller assembly.

3. The paper staging mechanism as claimed in claim 1, further comprising a feeding roller assembly, an image scanning mechanism and an exiting roller assembly, the feeding roller assembly is mounted to rear of the detecting mechanism and adjacent to the picking mechanism and the separating mechanism, the exiting roller assembly is mounted to rear of the feeding roller assembly, the image scanning mechanism is set between the feeding roller assembly and the exiting roller assembly.

4. The paper staging mechanism as claimed in claim 1, wherein the detecting mechanism is a gap sensor.

5. The paper staging mechanism as claimed in claim 1, wherein the sending component is set over the receiving component in vertical direction.

6. The paper staging mechanism as claimed in claim 5, wherein the sending component and the receiving component can swap places.

7. The paper staging mechanism as claimed in claim 1, wherein the sending component is set above the receiving component in a certain angle.

8. The paper staging mechanism as claimed in claim 7, wherein the sending component and the receiving component can swap places.

9. A paper staging mechanism capable of adjusting a relative distance between two adjacent papers in the process of being scanned, comprising:

a picking mechanism including a picking roller assembly, a pressing mechanism and a driving mechanism, the driving mechanism being mounted to a side of the picking roller assembly and driving the picking roller assembly to rotate, the pressing mechanism being located over the picking roller assembly, wherein the picking roller assembly rotates to pick up the paper and further feed the paper rearward under the cooperation of the pressing mechanism pressing against the paper;

a separating mechanism mounted to rear of the pressing mechanism and located over the picking roller assembly, wherein the separating mechanism separates the papers from the picking mechanism and further transmits the separated paper rearward; and a detecting mechanism mounted to rear of the picking mechanism and the separating mechanism, the detecting mechanism including a sending component and a receiving component which is apart disposed corresponding to the sending component, wherein the separated paper by the separating mechanism co-working with the picking roller assembly of the picking mechanism passes rearward through between the sending component and the receiving component of the detecting mechanism;

wherein the sending component and the receiving component of the detecting mechanism detect the relative distance between two adjacent papers which successively pass through the detecting mechanism, when the relative distance is abnormal, the detecting mechanism feeds back abnormal signals to the driving mechanism, and the driving mechanism controls the rotation of the picking roller assembly to speed up or slow down so as to achieve a fixed distance between two adjacent papers, wherein the picking roller assembly includes a first picking roller, a second picking roller and a third picking roller which are arranged in the same horizontal plane, the first picking roller is in front of the second picking roller and the third picking roller is between the first picking roller and the second picking roller, the pressing mechanism is located over the first picking roller and the third picking roller of the picking roller assembly, the separating mechanism is located over the second picking roller of the picking roller assembly, and wherein the driving mechanism includes a motor, a belt and a gear assembly, the motor of the driving mechanism is mounted to a side of the picking roller assembly for driving the second picking roller of the picking roller assembly to rotate, the belt of the driving mechanism is worn around the first picking roller and the second picking roller of the picking roller assembly, the second picking roller drives the first picking roller to synchronously rotate by the belt, the gear assembly is mounted to a side of the first picking roller and the third picking roller of the picking roller assembly and is meshed with one another, the first picking roller of the picking roller assembly drives the third picking roller to rotate by the gear assembly.

* * * * *